US005601490A

United States Patent [19]

Nakagawa et al.

[11] Patent Number: 5,601,490

[45] Date of Patent: Feb. 11, 1997

[54] TRACK RACING GAME MACHINE

[75] Inventors: Toshiaki Nakagawa, Fujimi; Hiroshi Yokota; Kouichi Ozaki, both of Tokyo-to; Kiyoshi Furukawa, Kobe, all of Japan

[73] Assignee: Konami Co., Ltd., Hyogo-ken, Japan

[21] Appl. No.: 294,525

[22] Filed: Aug. 23, 1994

[30] Foreign Application Priority Data

Aug. 25, 1993 [JP] Japan ..... 5-210737

[51] Int. Cl.$^6$ ..... A63F 9/14

[52] U.S. Cl. ..... 463/63; 446/446; 446/455

[58] Field of Search ..... 273/86 R, 86 B, 273/86 F, 85 G; 446/444, 446, 454, 455, 456; 340/323; 463/58, 63

[56] References Cited

U.S. PATENT DOCUMENTS

| | | | |
|---|---|---|---|
| 2,750,191 | 6/1956 | Denman | 273/86 B |
| 3,243,917 | 4/1966 | Giamarino et al. | 446/446 |
| 3,400,667 | 9/1968 | Case et al. | 273/86 B |
| 3,422,770 | 1/1969 | Celesia | 273/86 B |
| 4,349,196 | 9/1982 | Smith, III et al. | 273/86 B |
| 4,415,157 | 10/1983 | Lahr | 446/444 |
| 4,449,114 | 5/1984 | Fascenda et al. | 340/323 |
| 4,925,424 | 5/1990 | Takahashi | 446/455 |

FOREIGN PATENT DOCUMENTS

| | | | |
|---|---|---|---|
| 0516160 | 12/1992 | European Pat. Off. | 273/86 B |

*Primary Examiner*—Jessica Harrison
*Assistant Examiner*—James Schaaf
*Attorney, Agent, or Firm*—Jordan and Hamburg

[57] ABSTRACT

A track racing game machine Includes two or more vehicles having a drive motor and a pair of first and second contact members; a looped running track provided with a running lane along which the vehicles move; a power generator for generating a power of a specified level to be supplied to each vehicle to control the speed of the vehicle; and a plurality of pairs of supplying lines provided on the running lane of the running track to supply the power generated by the power generator to the corresponding vehicles, each pair consisting of first and second supplying lines, the first and second supplying lines being in contact with the first and second contact members of the corresponding vehicle, respectively.

11 Claims, 10 Drawing Sheets

TRACK RACING GAME MACHINE

BACKGROUND OF THE INVENTION

This invention relates to a racing game machine which simulates a race conducted on a track such as a horse race and a car race.

The racing game machine is designed to let players forecast the placing of moving objects which are formed to imitate horses and cars, for example and are caused to run on a looped track to compete one another. There has been known the racing game machine which is constructed such that the moving objects are caused to run in a desired direction and the positions of the moving objects are detectable. How the moving objects run is controlled in accordance with their winning percentages and their detected positions, so that the players can play with more of a presence and at a higher interest (Japanese Unexamined Patent Publication No. 1-259404).

In this racing game machine, each moving object is provided with a coil which generates a magnetic field of a given frequency and a position detection plate is provided on a bottom surface of the track, electric wires being laid on the position detection plate in both of X- and Y-directions to form multilayer. Where the magnetic field is generated is detected by the position detection plate so as to detect the position of the corresponding moving object. Further, routes of the respective moving objects are beforehand stored in a memory in the form of table and are randomly selected each race. The respective moving objects are caused to run along the set running routes by suitably correcting their running directions in accordance with the comparison results of the detected positions and running routes thereof.

Since the respective moving objects are caused to run along the predetermined running routes in the conventional racing game machine, players' interest in the race flags once the running patterns of the moving objects are known to them. If the number of the running patterns is increased in order not to predict easily which is selected among the running routes of the moving object for the player, then it requires a larger-sized memory for storing them. This is disadvantageous in terms of a cost.

Further, since the positions of the moving objects are detected using an X–Y coordinate system and the running directions thereof are calculated and controlled in accordance with the detected position information, it is complicated to detect the positions and to control the movement of the moving objects.

SUMMARY OF THE INVENTION

It is an object of the present invention to provide a game machine which has overcome the above problems residing in the prior art.

it is another object of the present invention to provide a game machine which has a simple construction and yet higher unpredictability about how a race proceeds, so that players can play the racing game at higher tension and with higher interest.

The invention is directed to a game machine comprising: two or more vehicles having a drive motor and a contactor; a running track provided with a running lane along which the vehicles move: a power generator for generating a power of a specified level to be supplied to each vehicle to control the speed of the vehicle; and a plurality of supplying lines provided on the running lane of the running track to supply the power generated by the power generator to the corresponding vehicles, the plurality of supplying lines being in contact with the contactor of each vehicle. The contactor may include a pair of first and second contact members. The supplying line may include a pair of first and second supplying lines in contact with the first and second contact members, respectively.

With this arrangement, the power generated for each vehicle by the power generator is supplied to the corresponding supplying line pair provided on the running lane of the running track. Each vehicle receives the power by bringing the contact members into contact with the corresponding supplying line pair and drives the drive motor with this power to move along the running lane.

The running lane may be formed with a guide groove for guiding the running of the runners. The plurality of supplying line pairs may be provided with a common first supplying line, the common first supplying line being provided in the guide groove. The first contact member in contact with the common first supplying line may include a guide pin fittable in the guide groove.

With this arrangement, the power generated for each vehicle by the power generator is supplied to the corresponding vehicle by way of the common first supplying line which acts as the one electrode and is provided in the guide groove of the running lane and the second supplying lines which act as the other electrode and are provided in correspondence with the respective vehicles on the surface of running track in parallel with the guide groove. Each vehicle receives the power generated by way of the guide pin which is fitted in the guide groove and is in contact with the common first supplying line and the second contact member which is in contact with the corresponding second supplying line provided on the surface of the running track and drives the drive motor with this power to move along the running lane. At this time, each vehicle moves along a specified course on the running lane while the guide pin is guided by the guide groove.

The second contact member in contact with the second supplying line may include a curved elastic strip member having a contact part provided with a plurality of steplike contact portions.

With this second contact member, when the lowest contact portion in contact with the second supplying line on the surface of the running track is abraded by a specified amount, the second lowest contact portion adjacent to the lowest one is brought into contact with the second supplying line. In this way, each time the contact portion is abraded by a specified amount, the next contact portion adjacent thereto is brought into pressing contact with the second supplying line.

It may be appreciated to further provide a controller for controlling the movement of the vehicles based on their respective positional information. The controller may be include: a signal transmitter mounted on each vehicle for transmitting an identification signal of the vehicle toward a running surface of the running track: a plurality of signal receivers provided at a plurality of predetermined positions on the running lanes of the running track for receiving the identification signal: and a position detector for detecting the position of each vehicle on the run in accordance with the identification signal detected by the signal receiver. The signal transmitter may include: an encoder for encoding an identification number set for each vehicle; and a light emitter for emitting a specified light in accordance with information obtained by encoding the identification number; and the receiver includes: a light receiver for receiving the light emitted from the light emitter.

With this arrangement, the movement of the vehicles is controlled in accordance with the positional information of each vehicle. The identification signals of the vehicles which are sent therefrom are received by the receiver provided at each position on the running track, and the position of the vehicles on the run are detected based on the detected identification signals and information of the predetermined positions. Also, the light representative of the information obtained by encoding the identification number is emitted from the vehicle and is received by the receiver provided at each predetermined position. For example, a racing number of each vehicle is encoded into a binary signal of n bits and a light emitting element is caused to emit in accordance with this binary signal. A light receiving element is provided at each predetermined position and the identification number is detected based on the light signal received by the light receiving element.

The running track may be provided with a lane branching region where one running lane separates into at least two branch lanes, the lane branching region having a lane switcher for switching the running lane of the vehicle. Also, it may be preferable to further provide a switching controller for controlling the switching of the lane switcher. The switching controller may be provided with a position detector for detecting the position of each vehicle on the run: a speed calculator for calculating the speed of each vehicle based on an amount of power supplied to this vehicle: and a lane determinator for determining the running lane of each vehicle in the lane branching region based on its speed calculated by the speed calculator and its position detected by the position detector; and a drive controlling device for controlling the driving of the lane switcher in accordance with the determination result of the lane determinator.

With this arrangement, the running lane of the vehicle can be changed to the other running lane by the lane switcher in the lane branching region. Also, the speed of each vehicle is calculated based on the power supplied thereto and the running lane thereof is determined based on the calculation result and the positional information detected by the position detector. Based on this determination result, the lane switcher Is controlled. Thus, each vehicle moves along the determined running lane in the lane branching region.

The running track may be provided with a multiple lane region where a plurality of running lanes are provided. The multiple lane region may include a lane changing region where the running lane of the vehicle is changed, the lane changing region having a lane changer for changing the running lane of the vehicle. Also, it may be preferable to further provide a changing controller for controlling the changing of the lane changer. The changing controller may be provided with a position detector for detecting the position of each vehicle on the run; a speed calculator for calculating the speed of each vehicle based on an amount of power supplied to this vehicle; and a lane determinator for determining the running lane of each vehicle in the lane changing region based on its speed calculated by the speed calculator and its position detected by the position detector; and a drive controlling device for controlling the driving of the lane changer in accordance with the determination result of the lane determinator. The running track may be further provided with a lane joining region where at least two running lanes join into one running lane.

With this arrangement, the running lane of the vehicle can be changed to the next one by the lane changer. The speed of each vehicle is calculated based on the power supplied thereto and the running lane thereof is determined based on the calculation result and the positional information detected by the position detector. Based on this determination result, the changer is controlled. Thus, each vehicle moves along the determined running lane in the lane changing region.

Also, the present invention is directed to a game machine comprising: two or more driving vehicles having contacting means; tracking means including a running lane along which the vehicles move; power generator means for generating a power of a specified level to be supplied to each driving vehicle to control the speed of the driving vehicle; and power supplying means for supplying the power generated by the power generator means to the corresponding driving vehicles, the power supplying means including a plurality of supplying lines in contact with the contacting means of the driving vehicles, the supplying lines being provided on the running lane of the tracking means.

These and other objects, features and advantages of the present invention will become more apparent upon a reading of the following detailed description and accompanying drawings.

DETAILED DESCRIPTION OF THE PREFERRED EMBODIMENTS OF THE INVENTION

A racing game machine as an example of a game machine according to the present invention will be described with reference to the accompanying drawings.

Figure 1:
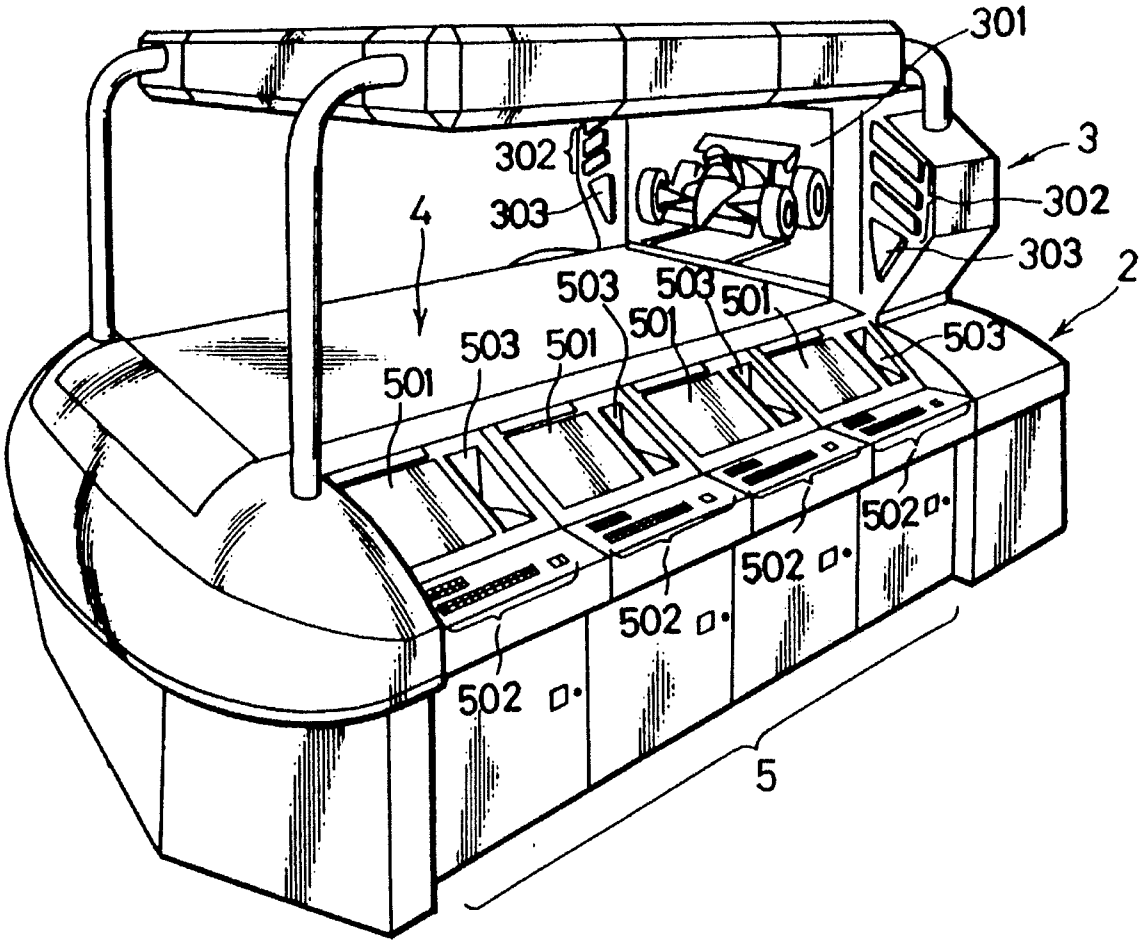
FIG. 1 is a perspective view showing an exterior of a racing game machine according to the present invention.
Figure 2:
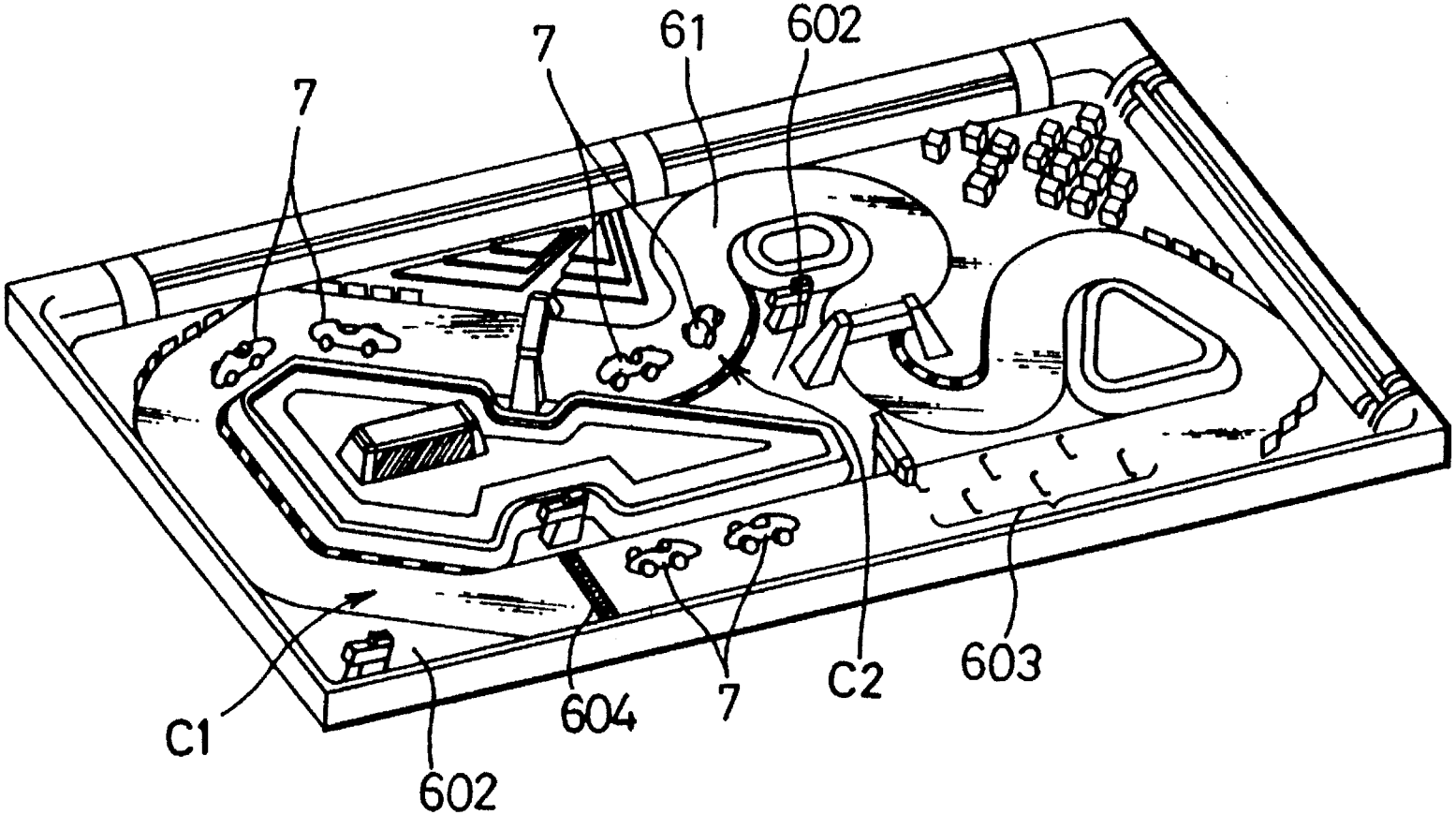
FIG. 2 is a perspective view showing a racing course of the racing game machine according to the present invention.

FIG. 1 is a perspective view showing the exterior of the racing game machine, and FIG. 2 is a perspective view showing a racing course of this game machine.

The game machine 1 includes a support 2 in the form of a horizontally elongated rectangular parallelepipeds and a display unit 3 projecting upward at one end of an upper surface of the support 2. The display unit 3 is provided with a display 301 including, for example, a projector type display device at the center of an inner surface thereof, and three kinds of lamps 302 having different colors and a loud speaker 303 at each side thereof. in the display unit 3 are displayed a variety of information such as demonstration video images, images of photographed racing cars and results of races. The three different color lamps 302 are used to indicate the start of the race and are turned on with delay from the uppermost one to the lowermost one in synchronization with the starting moment. Further, effect sounds and background music are output from the loud speaker 303.

On the upper surface of the support 2 is provided a racing unit 4 which performs a simulated car race by causing model racing cars to run. At each longitudinal side of the racing unit 4 are arranged four input units 5: eight input units 5 in total for one game machine 1. Using the input unit 5, players input their forecast on the winning cars of the race and the number of coins they bet.

A racing course 6 including a looped track 61 is provided in the racing unit 4 as shown in FIG. 2. Six racing cars 7 run on the track 61 to compete for the race. Start and goal positions 603 and 604 are provided on a straight portion of the track 61, and crash areas 602 are provided adjacent to a curve C1 which is positioned between the straight portion and a curved portion and a left curve C2 which is positioned in the middle of the curved portion, respectively. The crash areas 602 are provided for causing the racing cars 7 to hit each other during the race and accommodating the racing cars 7 evacuated from the racing course 6, so that players can feel more as if they were present at the race.

The car race is performed as follows: the respective racing cars 7 are started from the specified start positions 603 and are caused to circulate clockwise by a specified number of times so as to get better placing when they pass the goal position 604. After one race, the racing cars 7 are caused to run around the track 601 and set at the specified starting positions 603 for the next race. The starting positions 603 of the respective racing cars 7 are changed each race. It will be described later how the racing cars 7 are driven and progress of the race is controlled.

Each input unit 5 includes a display screen 501, input keys 502 and a coin insertion/payback portion 503. On the display screen 501 are displayed a variety of information concerning the race such as odds of the racing cars 7 at each race, ratio of dividend. i.e., how many coins will be paid back for each coin betted, and the result of the race. The input keys 502 are used to input the winning forecast and the number of coins to be betted. The winning forecast can be made, for example, on a winning horse or a combination of horses winning the specified places. If the winning forecast comes true, the coins which are the ratio of dividend times the coins betted are returned from the portion 503.

A driving mechanism for the racing car 7 will be described next with reference to FIGS. 3 to 10.

Figure 3:
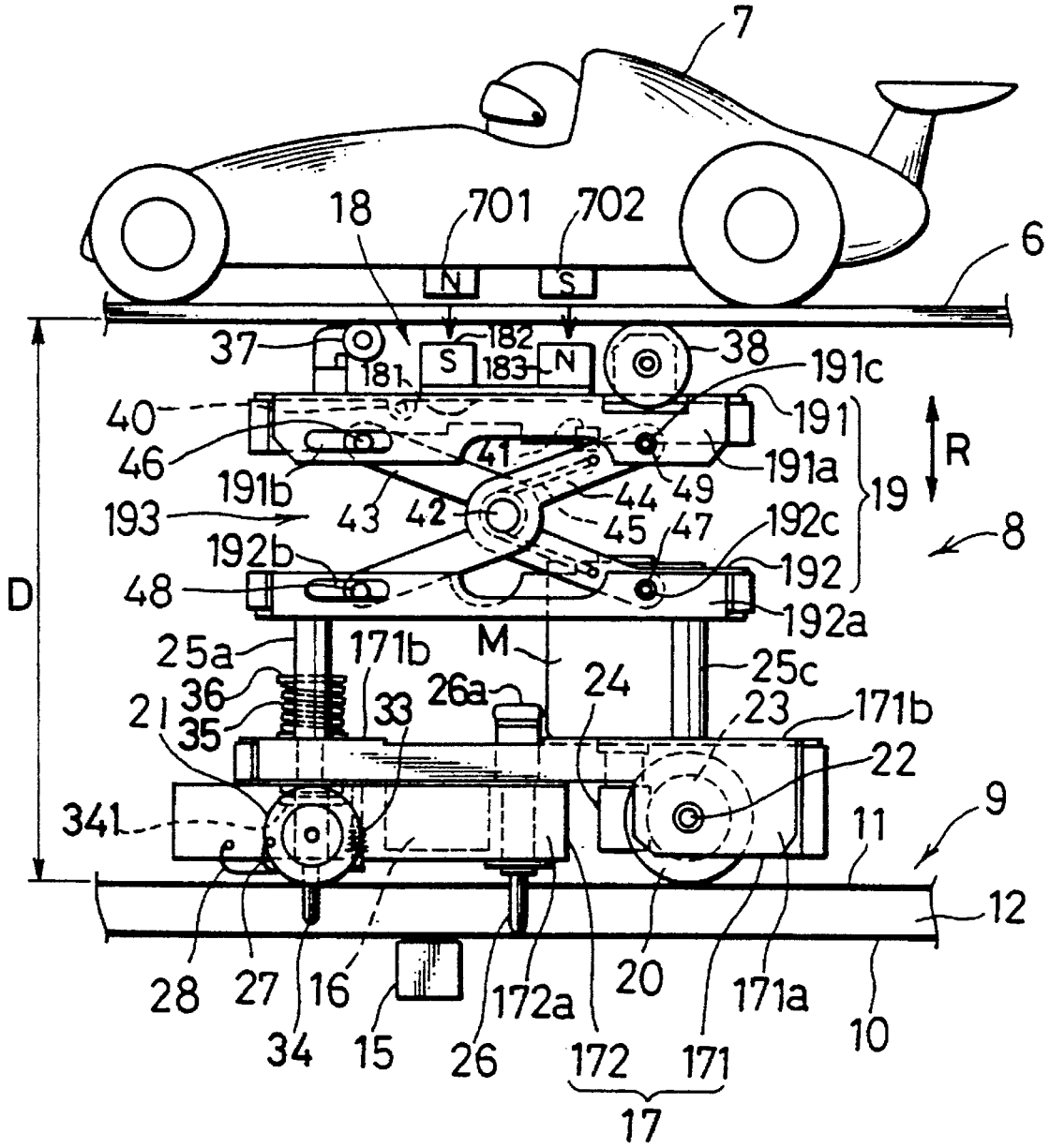
FIG. 3 is a side view in section showing an overall construction of a driving mechanism for a racing car.
Figure 4:
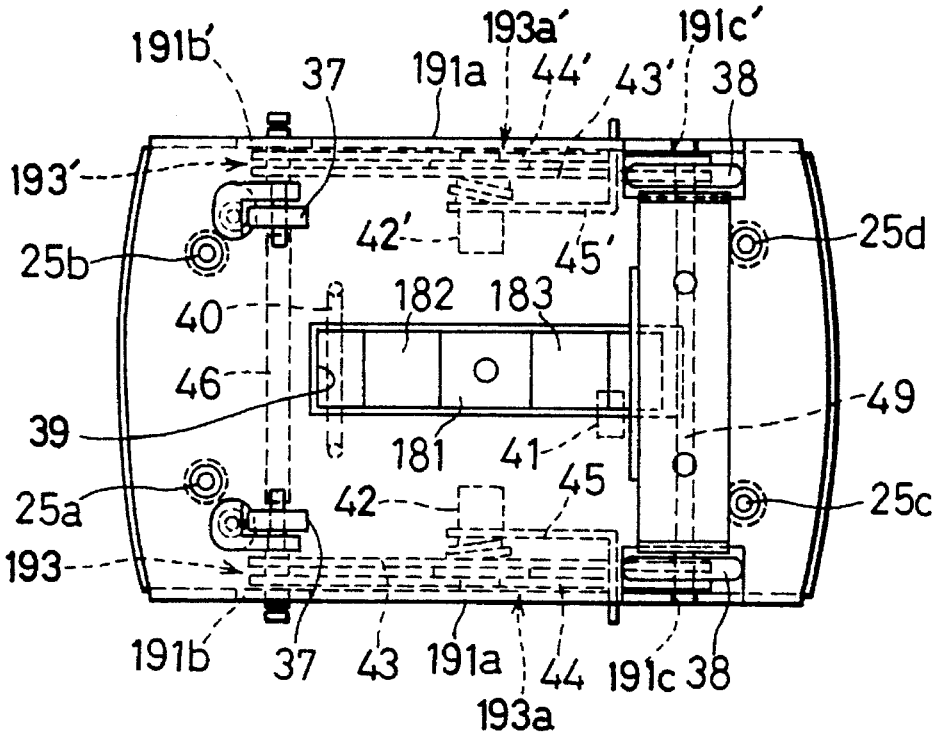
FIG. 4 is a plan view showing a driving machine.
Figure 5:
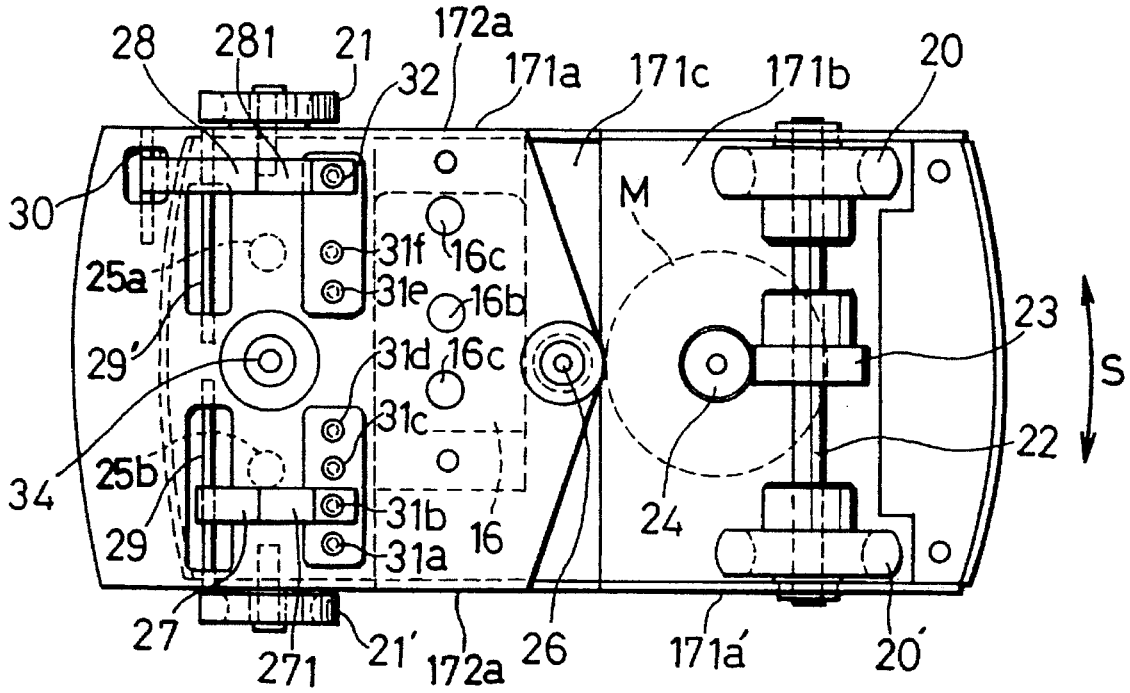
FIG. 5 is a bottom view showing the driving machine.
Figure 6:
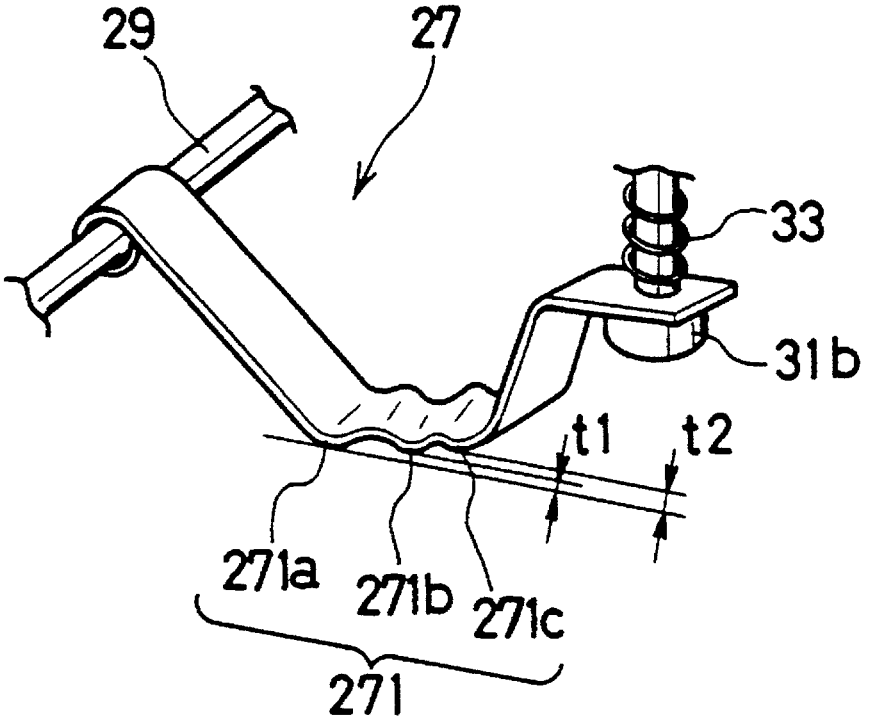
FIG. 6 is a perspective view showing a construction of a contact member.
Figure 7:
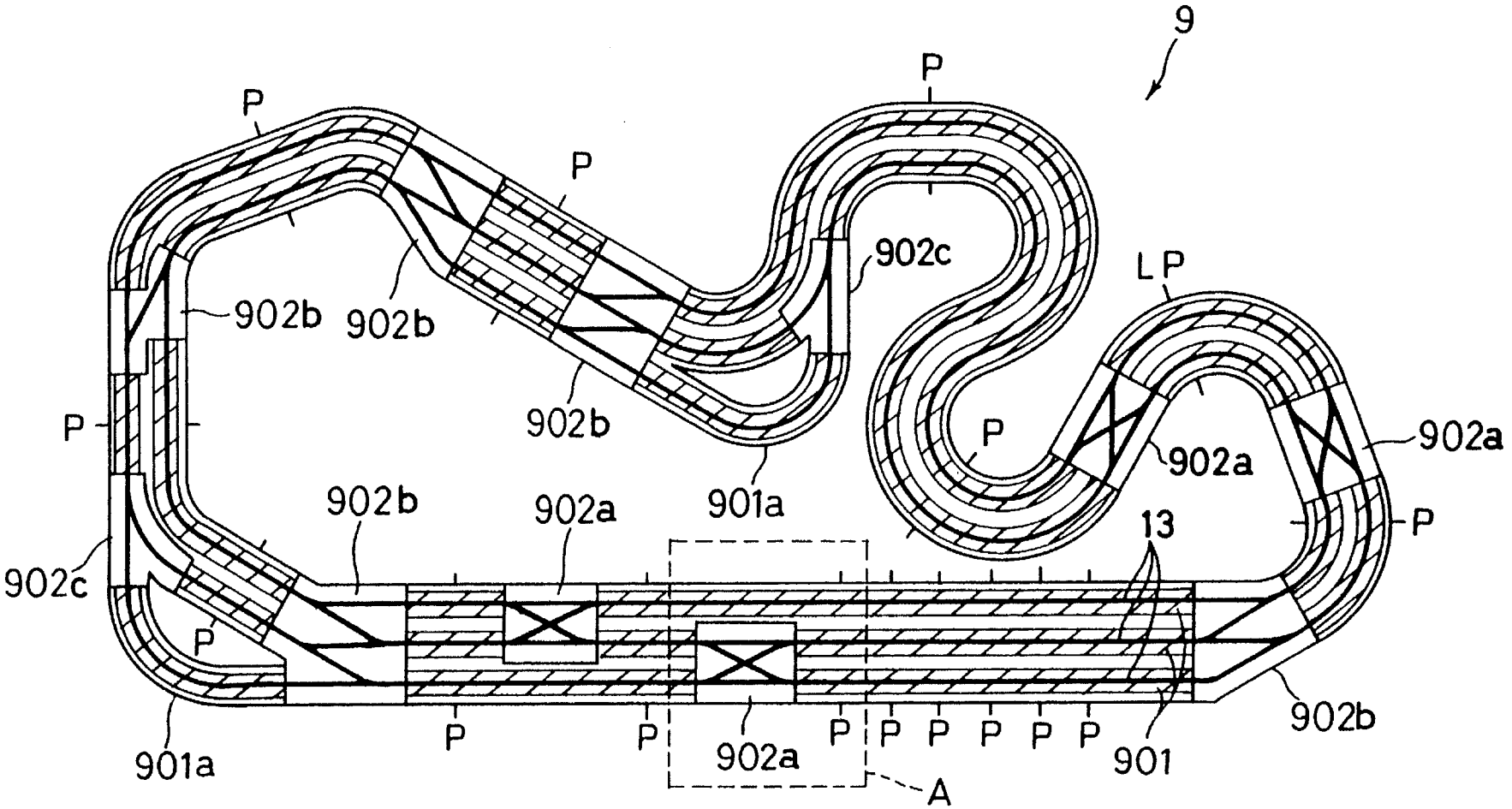
FIG. 7 is a plan view showing a running track along which the driving machines are caused to run.
Figure 8:
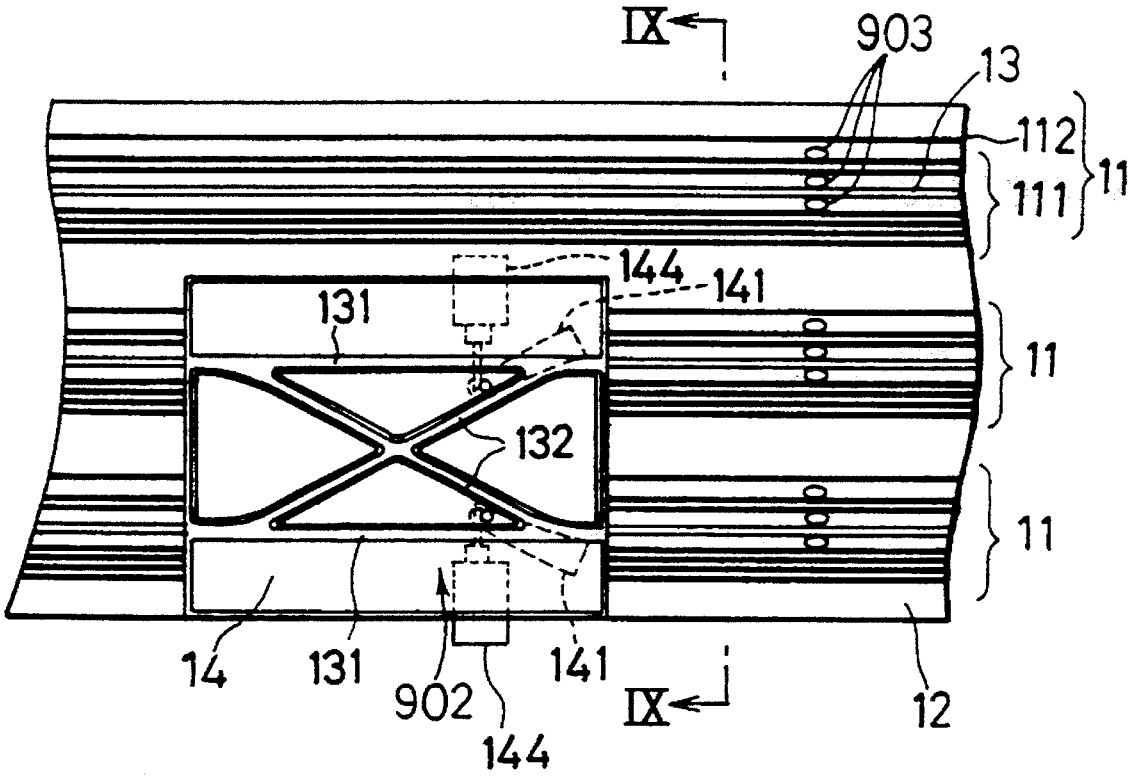
FIG. 8 is a partially enlarged view of a region A in FIG. 7.
Figure 9:
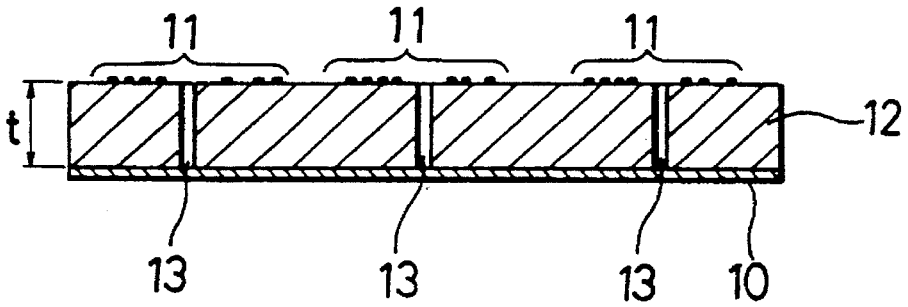
FIG. 9 is a sectional view taken along the line IX—IX in FIG. 8.
Figure 10:
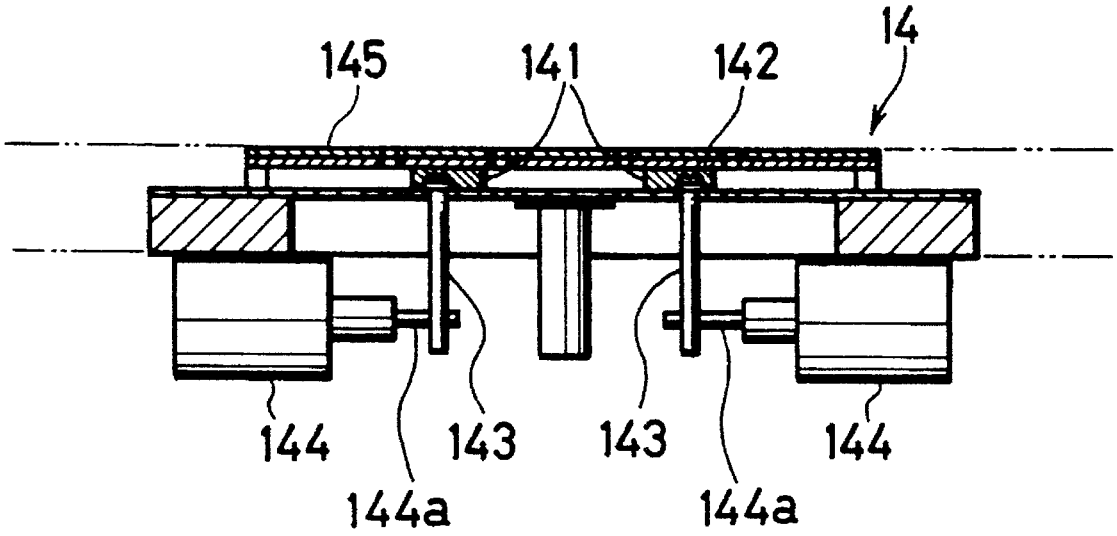
FIG. 10 is a sectional view showing a construction of a lane changing device.

FIG. 3 is a side view in section showing an overall construct ion of the driving mechanism. FIGS. 4 and 5 are a plan view in section and a bottom view in section showing a driving machine. FIG. 6 is a perspective view showing a construction of a contact member. FIG. 7 is a plan view showing a running track along which the racing cars are caused to run. FIG. 8 is a partially enlarged view of a region A in FIG. 7. FIG. 9 is a sectional view taken along the line IX—IX in FIG. 8. FIG. 10 is a sectional view showing a construction of a lane changing device.

The racing game machine is provided with driving machines 8, below the track 6, which actually move. The racing car 7 is attracted to the corresponding driving machine 8 by use of a magnet, so that the racing car 7 moves along with the driving machine 8. More specifically, the track 601 and the racing cars 7 are dummies to express the running states of the runners 8. By letting the simulated moving objects (racing cars 7) move along with driving machines 8 while being magnetically attracted thereto, the driving mechanism for the racing cars 7 can be hidden completely and the players can feel more as if they were present at the race.

The driving mechanism for the racing cars 7 is provided below the racing course 6 and includes six driving machines 8 corresponding to the respective racing cars 7 and a running track 9 along which the driving machines 8 are caused to run. The running track 9 is shaped in substantially the same manner as the track 601 of the racing course 6 (see FIG. 7) and is located below and in parallel with the track 601 by a given distance D.

The driving machines 8 are installed between the racing course 6 and the running track 9 and move along running lanes 901 provided on the running track 9. Each driving machine 8 has a drive motor M, which is driven upon receipt of power supplied by way of supplying lines 10 and 11 provided in the running track 9. When the drive motors H are energized, the driving machines 8 move along the running lanes 901 of the running track 9. A detailed construction of the driving machine 8 will be described later.

The racing car 7 is provided with a pair of permanent magnets 701 and 702 at suitable positions of the bottom surface of its car body. The racing car 7 is attracted to the corresponding driving machine 8 by the attraction acting between these magnets 701 and 702 and a pair of permanent magnets 182 and 183 provided at an upper part of the driving machine 8. Accordingly, when the driving machine 8 moves on the running track 9, the racing car 7 attracted to this driving machine 8 moves on the racing course 6.

The running track 9 includes two or three running lanes 901 as shown in FIG. 7 and the driving machines 8 run along these running lanes 901. A part of the running track 9 corresponding to the straight portion of the track 601 has three running lanes 901, and the other portion thereof has two running lanes 901.

A plurality of lane changing regions 902*a*, lane joining regions 902*b* and lane branching regions 902*c* are provided at specified parts of the running track 9. The running lanes 901 of the runners 8 can be changed in these regions 902*a*, 902*b* and 902*c*. In regions (hereafter referred to as normal running regions) of the running track 9 other than the lane changing regions 902*a*. lane joining regions 902*b* and lane branching regions 902*c*. there are provided a plurality of position detecting points P for detecting the positions of the driving machines 8 on the run.

There are also provided crash lanes 901*a* corresponding to the crash areas 602 of the racing course 6. The driving machine 8 moving along the outermost running lane 901 is generally controlled so that its lane is changed to an inner lane 901 in the lane branching regions 902*b* provided before the curves C1 and C2 so as not to hit each other. However, a hit occurs when the lane of the driving machine 8 moving along the outer lane 901 cannot be changed to the inner one because of progress of the race, i.e., the high speed thereof when entering the curves C1 and C2 and the positional relationship with the other driving machines 8 or when the hit is beforehand preprogrammed. In such a case, the driving machine 8 is controlled to move along the crash lane 901*a*.

The normal running regions of the running track 9 has a double-layer structure as shown in FIG. 9: a conduction plate 10 made of metal such as aluminum or like and an insulation plate 12 having a specified thickness of t and made of synthetic resin such as acrylic resin or the like, the plate 12 being placed on the plate 10. In the middle of each running lane 901 is formed a guide groove 13 having such a depth that a bottom of the guide groove 13 reaches the conduction plate 10. In parallel with the guide groove 13, there are provided seven conduction lines 11 made of, conductive member such as copper or the like.

Three through holes 903 are formed in each running lane 901 at the position detecting points P of the running track 9 and a position detection sensor 15 is disposed below these holes 903 (see FIG. 3). The position detection sensor 15 includes three light receiving elements which are positioned in or below the corresponding holes 903.

Each driving machine 8 has a light emitting device 16 including three light emitting elements (see FIG. 3). The light emitting device 16 encodes an identification number given to the driving machine 8, e.g., a racing number N (N=1 to 6) in the form of a binary signal of three bits and emits this signal of three bits toward a running surface of the running track 9. The position detection sensor 15 detects the racing number N represented by three bits, thereby detecting the driving machine 8 which has passed over this position detection sensor 15.

Although an optical signal of three bits is emitted and received as a parallel signal in this embodiment, it may be emitted and received as a serial signal. Further, although the position of the driving machine 8 is detected using an optical signal in this embodiment, it may be detected by a non-contact method by causing each driving machine 8 to generate a magnetic or electric field modulated therefor and detecting this magnetic or electric field.

The position of the driving machine 8 can be detected by a contact method. For example, a switch having contacts is disposed on the surface of the running track 9 in place of the holes 903 and each driving machine 8 is provided with levers which come to contact with the corresponding contacts. A specified contact is closed when the driving machine 8 passes over the switch. In this case, it may be appropriate that the switch have a single contact and that each driving machine 8 have a different number of levers arranged in line in a longitudinal direction thereof, so that the position of the driving machine 8 is detected by closing the switch by the number of times corresponding to the identification signal of the driving machine 8 when it passes over the switch.

The conduction plate 10 constitutes a supplying line acting as a (+)electrode for supplying power to the drive motor and light emitting device of the driving machine 8, while the conduction lines 11 constitute supplying lines acting as a (–)electrode for supplying the power to the driving machine 8. Outer six of the seven conduction lines 11 on each running lane 901 are provided in correspondence with the drive motor M of each of the six driving machines 8. By providing the different (–)side supplying lines for supplying the power, the movement of the respective driving machines 8 can be individually controlled even when a plurality of driving machines 8 move along the same running lane 901. A chopper circuit (see FIG. 11) is connected with each conduction line 11. The speed of each driving machine 8 is controlled by controlling the voltage of the power supplied to the drive motor M by way of the conduction plate 10 and the conduction lines 11.

The innermost one of the seven conduction lines 11 of the running lane 901 is a (–)side supplying line for supplying the power to the light emitting device 15 of the driving machine 8. A (–)side supplying line for the light emitting device 15 is common among the respective driving machines 8, since the same control is executed for each light emitting device 15.

The lane changing region 902*a* of the running track 9 is, as shown in FIG. 8, provided with a lane changing device 14 which includes main guide grooves 131 corresponding to the main running lanes 901 and branch guide grooves 132. Each branch guide groove 132 is branched from one main guide groove 131 and joins the other main guide groove 131. At positions where the branch guide grooves 132 are branched and between upper and lower faces of the lane changing device 14, flips 141 in the form of a strip are provided to separate the guide groove 13 into the main guide groove 131 and branch guide groove 132. The flips 141 may be provided on the upper face of the lane changing device 14.

As shown in FIG. 10, each flip 141 has a leading end rotatably mounted on a support 142 and is switched between a first position where it guides a contact pin 26 and a guide pin 34 (see FIG. 3) of the driving machine 8 to the main guide groove 131 and a second position where it guides them to the branch guide groove 132. More specifically, a lever 143 coupled with a plunger 144*a* of a solenoid 144 is mounted at the leading end of the flip 141. When the solenoid 144 is turned on, the plunger 144*a* retracts to thereby bring the flip 141 into the first position. When the solenoid 144 is turned off, the plunger 144*a* projects to thereby bring the flip 141 into the second position.

On the upper surface of the lane changing device 14 is mounted a conduction plate 145 made of metal such as aluminum or the like and isolated from the conductive lines 11 in the normal running regions. This conduction plate 145, acting as a (–)electrode for supplying the power to the driving machine 8, is a single plate because the respective driving machines 8 are not controlled individually in the lane changing regions 902*a* and a common (–)electrode is used for the driving machines 8.

The construction of the lane branching regions 902*b* is similar to that of the lane changing regions 902*a* except that the branch guide grooves do not cross each other. Further, the construction of the lane joining regions 902*c* is similar to that of the lane changing regions 902*a* except that the branch guide grooves 132 and the flips 141 are not provided.

The driving machine 8 is described next in detail.

The driving machine 8 mainly includes a truck 17 for mounting the drive motor M, a magnet unit 18 for magnetically attracting the corresponding racing car 7 so as to cause the racing car 7 to move along with the truck 17, and a support member 19 for supporting the magnet unit 18 and helping the truck 17 move stably.

The truck 17 is provided with a first frame 171 carrying rear wheels 20, 20' and a second frame 172 carrying front wheels 21, 21'. The first frame 171 is a frame of a horizontally elongated rectangular shape, when viewed downward from the above. Longitudinal side (longer side) portions are bent vertically downward to form side walls 171*a*, 171*a'*. A drive shaft 22 is rotatably mounted at suitable rear end positions of the side walls 171*a*, 171*a'*. The rear wheels 20, 20' are mounted at opposite ends of the shaft 22 and a drive gear 23 is fixed on the middle of the shaft 22.

A planar portion 171*b* of the first frame 171 is separated into a front planar portion and a rear planar portion by a through hole 171*c* formed at a center portion thereof. The drive motor M is mounted substantially in the middle of the rear planar portion. A worm gear 24 is fixed at a leading end of rotatable shaft of the drive motor M. This worm gear 24 is spirally engaged with the drive gear 23. When the drive motor M is driven, a torque thereof is transmitted to the rear wheels 20, 20' by way of the worm gear 24, drive gear 23 and drive shaft 22. The truck 17 is caused to run by rotating the rear wheels 20, 20'. Four support bars 25*a* to 25*d* project upward at specified positions of the front and rear planar portions. The support member 19 is mounted on leading ends of these support bars 25*a* to 25*d*.

The second frame 172 is a frame of a substantially pentagonal shape, when viewed downward from the above. Specifically, the frame 172 is of the shape obtained by connecting a bottom side of a triangle with a rear side of a horizontally elongated rectangular. The front wheels 21, 21' are mounted at specified positions of side walls 172*a*, 172*a'*. The contact pin 26 made of conductive material is inserted and fixed at a rear end position of the second frame 172. This contact pin 26 acts as a guide member for guiding the running of the truck 17 and as a terminal of a (+)electrode for receiving the power by way of the running track 9. A bottom end portion of the contact pin 26 has a diameter slightly smaller than a width of the guide groove 13 of the running track 9, and a bottom end thereof acts as a contact with the conduction plate 10. An upper end portion 26*a* of the contact pin 26 acts as a terminal of a (+)electrode. The contact portion 26*a* is connected with the drive motor M, so that the power received by way of the running track 9 can be supplied to the drive motor M.

A roller or ball made of conductor may be provided which is rotatably supported on the contact portion of the contact pin 26 and a slip ring may be arranged at this supported portion, so as to reduce a frictional force acting between the conduction plate 10 and the contact portion.

The light emitting device 16 is provided substantially at the center of the second frame 172. The light emitting device 16 includes three light emitting elements 16*a*, 16*b* and 16*c* for emitting light onto the running surface of the running track 9. These elements 16*a*, 16*b*, and 16*c* encode an identification number allotted to the driving machine 8, e.g., a racing number N in the form of a binary number. It will be appreciated that the identification number is a desired number and is not limited to a racing number.

The light emitting elements 16*a*, 16*b* and 16*c* correspond to digits $2^2$, $2^1$, and $2^0$, respectively. For example, the racing number 6 (=110B) is represented by a three-bit signal by turning on the elements 16*a* and 16*b* while tuning off the element 16*c*. The lights emitted from the elements 16*a*, 16*b* and 16*c* are received by the corresponding light receiving elements of the position detection sensor 15, thereby being detected as a three-bit signal. The position of the driving machine 8 is detected by the presence or absence of this signal and the number represented thereby.

When the racing number is "0," none of the light emitting elements 16*a*, 16*b* and 16*c* is supposed to emit the light. Since this leads to the inability to detect the presence or absence of the detection signal, the racing number "0" is not used.

The end portion 26*a* of the contact pin 26 is also connected with the light emitting device 16 via a switch 41 to be described later, so that the power received by way of the running truck 9 can be supplied also to the light emitting device 16.

At specified front end positions of a bottom surface of the second frame 172, there are provided a contact member 27 which acts as a terminal of a (–)electrode of the drive motor M and a contact member 28 which acts as a terminal of a (–)electrode of the light emitting device 16.

The contact member 27 is a plate made of metal having elasticity such as phosphor bronze or the like. As shown in FIG. 6, the metal plate is curved downward to form a contact part 271, which is bent and formed into a steplike shape so as to form three contact points 271*a*, 271*b* and 271*c*. The levels of these contact portions are set lower in the order of 271*a*, 271*b* and 271*c*. The contact portions 271*b* and 271*c* are higher than the contact portion 271*a* by distances t1 and t2, respectively. This is designed to prevent an imperfect contact of the contact member 27 with the conduction line 11 of the running track 9. When the contact portion 271*a* is abraded by t1, the next contact portion 271*b* comes into pressing contact with the conduction line 11. When the contact portion 271*b* is abraded by (t2–t1), the last contact portion 271*c* comes into pressing contact with the conduction line 11.

When the contact part 271 is formed into a planar shape, a contact surface becomes uneven due to the abrasion caused by the friction. However, when the contact portions 271*a*, 271*b* and 271*c* are brought into pressing contact with the conduction line 11 only after the lower located contact portions are abraded by a specified amount and thus the contact part 271 is brought into pressing contact at one point or line, the contact part 271 is securely brought into contact with the conduction line 11, thereby reducing a likelihood of an imperfect contact. The number of the contact portions of the contact part 271 is not limited to 3, but may be set to a desired number.

A base end of the contact member 27 is rotatably mounted on a shaft 29 or 29' provided at the bottom surface of the front end portion of the second frame 172 in parallel with the shaft carrying the front wheels 21, 21'. A leading end of the contact member 27 is mounted on a specified one of six fixing pins 31*a* to 31*f* (in this embodiment, fixing pin 31*b*) provided behind the shafts 29, 29'. A spring 33 (see FIG. 6) is fitted on each of the fixing pins 31*a* to 31*f*, thereby the leading end of the contact member 27 is biased downward to bring the contact portions 271*a*, 271*b* and 271*c* of the contact part 271 one after another into pressing contact with the conduction line ((–)electrode) 11 of the running track 9.

The six fixing pins 31*a* to 31*f* are provided so as to bring the contact member 27 into contact with the conduction line 11 corresponding to each driving machine 8. The fixing pin 31 for each driving machine 8 is predetermined in correspondence with the mounting position of the contact member 27. For example, when the six conduction lines 11 provided on each running lane 901 are allotted to the driving machines 8 having racing numbers of 1 to 6 from the outermost one to the innermost one, the contact members 27 of the respective driving machines 8 having racing number of 1 to 6 are fixed on the fixing pins 31*a*, 31*b*, . . . and 31*f*, respectively.

The contact member 28 has substantially the same construction as the contact member 27. A base end thereof is rotatably mounted on a shaft 30, and a leading end thereof is fixed on a fixing pin 32.

The front end portion of the first frame 171 is placed over the second frame 172 and is connected therewith at one point by the guide pin 34. Specifically, holes are formed between the support bars 25*a* and 25*b* of the front planar portion of the first frame 171 and a position of the second frame 172 above the middle of shaft carrying the front wheels 21. 21'. respectively. The guide pin 34 is inserted through these holes, thereby connecting the frames 171 and 172.

A flange 341 is formed at an intermediate position of the guide pin 34, thereby the cross section of the guide pin 34 being formed crosswise. A part of the guide pin 34 above the flange 341 is inserted into the holes formed in the frames 171 from an underside of the second frame 172. A spring 35 is mounted on an upper end portion of the guide pin 34 projecting upward from the first frame 171, and a restricting plate 36 is mounted at an upper end of the guide pin 34 so as to prevent the spring 35 from getting off the guide pin 34.

Since the guide pin 34 is biased upward by the spring 35 in the above arrangement, the first and second frames 171 and 172 can be held securely tightly between the flange 341 of the guide pin 34 and the spring 35. Since the lower ends of the guide pin 34 and contact pin 26 are fitted in the guide groove 13 formed in the running track 9 and thus the second frame 172 is guided at two points, the truck 17 stably runs on the running lane 901.

Since the first frame 171 is connected with the second frame 172 only by the guide pin 34 and is rotatable about the guide pin 34, it is allowed to move freely relative to the second frame 172 in a direction substantially normal to a running direction (i.e., a direction of S in FIG. 5), thereby allowing the truck 17 to run smoothly.

The support member 19 includes an upper plate member 191, a lower plate member 192 and a link mechanism 193. The members 191 and 192 are opposed in parallel with each other in the vertical direction. The link mechanism 193 connects the members 191 and 192 movably upward and downward.

The upper plate member 191 is of horizontally elongated rectangular shape, when viewed downward from the above. Longer side (longitudinal side) portions are bent vertically downward to form side walls 191*a*, 191*a'*. Horizontally extending oblong holes 191*b*, 191*b'* and round holes 191*c*, 191*c'* are formed at specified positions of front and rear end portions of the side walls 191*a*, 191*a'*, respectively. On an upper surface of the plate member 191, there are provided a pair of front rollers 37, 37' at front end cornets and a pair of rear rollers 38, 38' having a diameter larger than that of the front rollers 37, 37' at rear end corners. The front rollers 37, 37' and the rear rollers 38, 38' are mounted on the plate member 191 such that upper end positions thereof are at the same level of height.

At the center of the plate member 191 is formed, as shown in FIG. 4, a long rectangular hole 39, in which the magnet unit 18 is placed. The magnet unit 18 is such that two permanent magnets 182, 183 having opposite polarities are arranged on an upper surface of a small rectangular substrate 181 with being spaced apart by a given distance.

One end of the substrate 181 is rotatably mounted on a shaft 40 provided in the plate member 191. The magnet unit 18 is switchingly movable between a set position where the substrate 181 is horizontally held and a reset position where the other end (free end) of the substrate 181 is located at a lower position as a result of the downward rotation of the substrate 181 by a specified angle. The plate member 191 is also provided with a switch 41 at a position lower than the free end of the substrate 181. This switch 41 is turned on when the magnet unit 18 is in the set position, while being turned off when the magnet unit 18 is in the reset position.

When the racing car 7 is attracted to the truck 17, the magnet unit 18 is in the set position because of the attraction of the permanent magnets 701 and 702 of the racing car 7. However, when the racing car 7 is disengaged from the truck 17, the magnet unit 18 returns to its reset position because of the absence of the attraction of the permanent magnets 701 and 702. When the magnet unit 18 returns to its reset position, the switch 41 is brought into its shut-off state, with the result that the supply of power to the light emitting device 16 is stopped. Based on this state, the disengagement of the racing car 7 from the truck 17 is detected.

The lower plate member 192 is of horizontally elongated rectangular shape, when viewed downward from the above. Longer side (longitudinal side) portions are bent vertically downward to form side walls 192*a*, 192*a'*. Similar to the upper plate member 191, horizontally extending oblong holes 192*b*, 192*b'* and round holes 192*c*, 192*c'* are formed at specified positions of front and rear end portions of the side walls 192*a*, 192*a'*, respectively. A planar portion of the plate member 192 is fixed on the leading ends of the four support bars 25*a* to 25*d*.

The linking mechanism 193 is provided with a first link unit 193*a* and a second link unit 193*a'*. The first link unit 193*a* includes links 43, 44 which are crossed in the middle and have the same length, a shaft 42 for rotatably connecting the links 43, 44, and a helical spring 45 for giving a biasing force so that ends (right ends in FIG. 3) of the links 43, 44 move away from each other (in a direction of R in FIG. 3). The second link unit 193*a'* has the same construction as the first link unit 193*a*. The opposing ends of links 43, 43' and 44, 44' are coupled with shafts 46, 47, 48 and 49.

The shafts 46 and 49 are rotatably fitted in the oblong holes 191*b*, 191*b'* and the round holes 191*c*, 191*c'* of the upper plate member 191, respectively. The shafts 47 and 48 are rotatably fitted in the oblong holes 192*b*, 192*b'* and the round holes 192*c*, 192*c'* of the lower plate member 192. In this way, the upper and lower plate members 191 and 192 are coupled by way of the link mechanism 193.

With the above arrangement, the upper plate member 191 is biased upward by the biasing forces from the helical springs 45, 45' of the link mechanism 193 to thereby bring the front and rear rollers 37, 37' and 38, 38' into pressing contact with the underside of the racing course 6 with a given pressure. On the other hand, the lower plate member 192 and the truck 17 are biased downward to thereby bring the front and rear wheels 21. 21' and 22, 22' and the lower end of the contact pin 26 into pressing contact with the running surface of the running track 9 and the conduction plate 10 with given pressures. respectively. Thus, the driving machine 8 is enabled to run stably.

A means to bias the upper plate member 191 upward is not limited to the above. Any desired means can be applied provided that it is capable of biasing the upper plate member 191 upward and in parallel with the lower plate member 192. For example, a plurality of identical springs may be provided between the upper and lower plate members 191 and 192.

Figure 11:
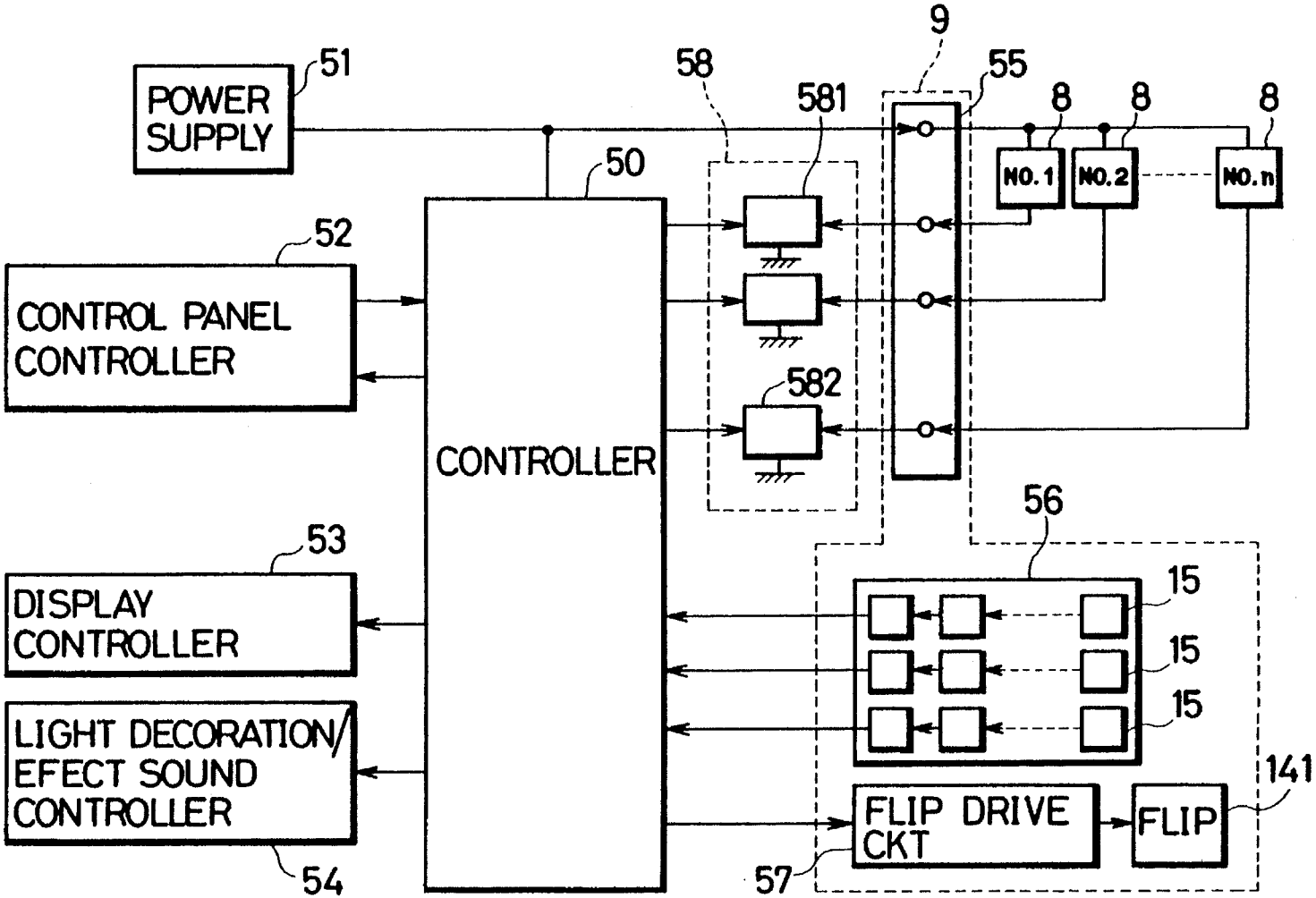
FIG. 11 is a block construction diagram of the game machine.

FIG. 11 is a construction block diagram of the racing game machine.

In this figure, indicated at 50 is a controller for centrally controlling a game operation of the racing game machine. A power supply 51 is a dc power supply for supplying given dc powers to the driving machines 8. A control panel controller 52 controls the driving of each element of the input unit 5 and is driven in accordance with a control signal from the controller 50. The information input by the input unit 5, such as a winning forecast and the number of coins to be betted, is input to the controller 50 by way of the control panel controller 52.

A display controller 53 controls the driving and display contents of the display 301 and is driven in accordance with a control signal from the controller 50. A light decoration/effect sound controller 54 controls the driving of the lamps 302, loud speakers 303 and other elements for producing light decoration effect and sound effect, and is driven in accordance with a control signal from the controller 50. The controller 50 generates information for the specified light decoration effect and sound effect based on a stand-by state and the progress of the race and sends the generated information to the light decoration/effect sound controller 54.

A power supplier 55 is a power terminal for supplying the power to the driving machines 8 and includes the conduction plates 10, 145 and conduction lines 11 of the running track 9. A position detector 56 detects the position of the driving machines 8 on the run and includes the position detection sensors 15 disposed at the position detecting points P provided along the running lanes 901. The signals represented by the light received by each position detection sensor 15 is input to the controller 50 together with the information concerning the position detecting points P and the running lanes 901.

A flip drive circuit 57 controls the driving of the solenoid 144 in accordance with a control signal from the controller 50. A power controller 58 includes a plurality of chopper circuits 581, 582, . . . in correspondence with the respective runners 8 and controls the power to be supplied to the driving machines 8. More specifically, each chopper circuit carries out a PWM (pulse width modulation) control or PFM (pulse frequency modulation) control to change the voltage of the dc power supplied to the corresponding runner 8 in accordance with the control signal from the controller 50, thereby controlling the speed of the runner 8.

Figure 12:
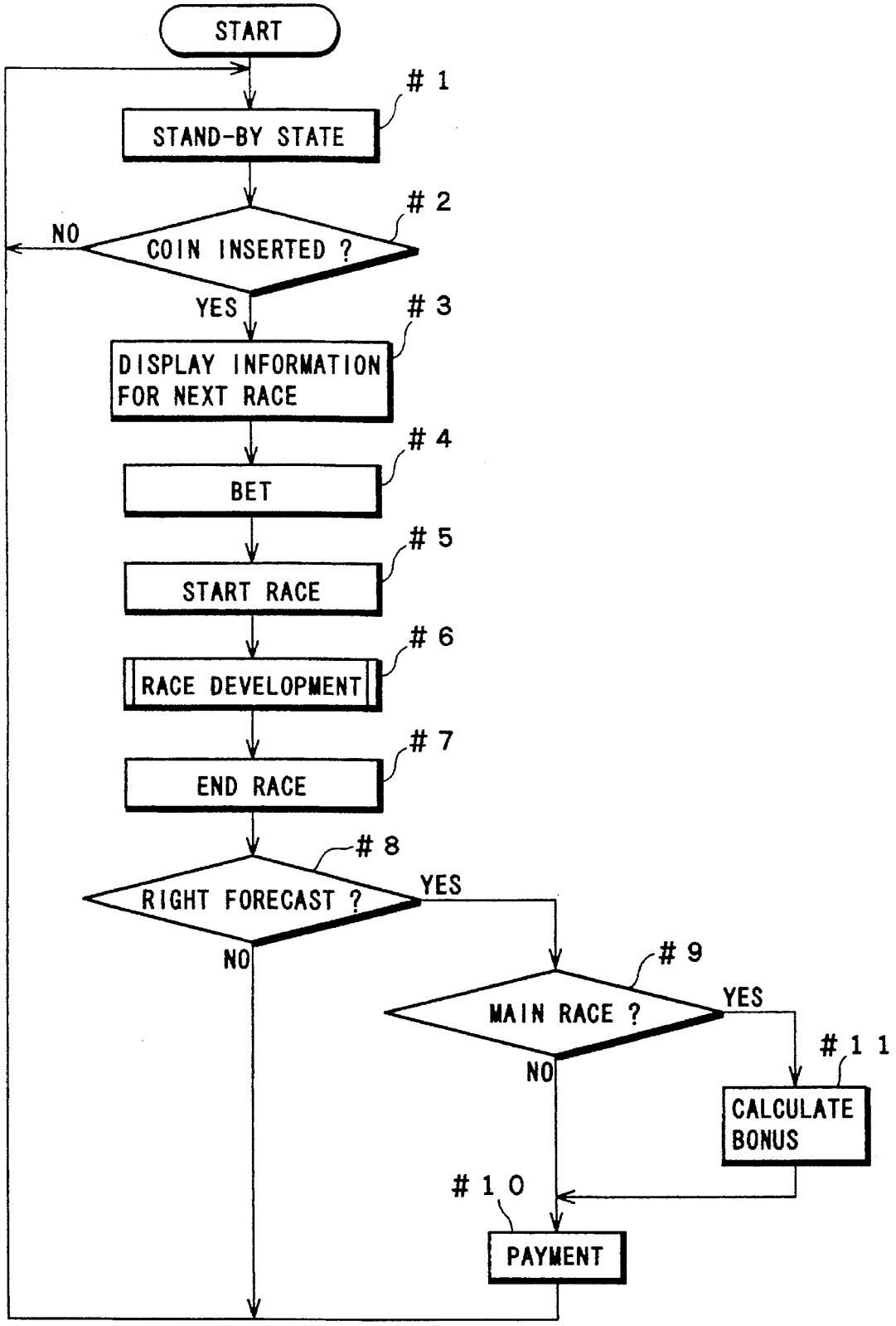
FIG. 12 is a main flow chart showing an operation of the game machine.

Next, the operation of the racing game machine will be briefly described with reference to a flow chart shown in FIG. 12.

The racing game machine is activated when a main power supply is turned on and stays in its stand-by state until a coin is inserted in any one of the input units 5 (a loop of Steps #1 and #2). When it is detected that a coin is inserted in any one of the input units 5 (YES in Step #2), the game is started and information for the next race is displayed in the display 301 and the display screen 501 of each input unit 5 (Step #3).

The race information includes odds (payback ratio) of a bet made on a winning car and a combination of cars winning specified places and the kind of the race and are selected from preprogrammed odds data and race data by performing a specified operation. There are different kinds of races, e.g., a normal race where a payback is made based on the specified payback ratio and race where a bonus is paid in addition to the normal payback. A player distributes the inserted coins for a plurality of winning combinations he forecasts and completes the operation of inputting his winning forecast by pressing a confirmation button (Step #4).

When all the players complete the input operation for their winning forecasts, the car race is started (Step #5). The car race is designed to compete the placing of the six racing cars when they reach the goal position 604 after circulating the track 601 a specified number of times. In starting the race, the three lamps 302 of the display unit 3 are turned on one after another and all the racing cars 7 start running at the same time when the last lamp 302 is turned on. Each racing car 7 moves on the track 601 while the speed and running lane thereof is controlled in accordance with the predetermined program.

The speed and running lane of each racing car 7 is controlled, for example, in accordance with the odds information, and the present speed and position thereof. For example, since the racing car having a lower odds has a higher possibility of winning than the racing car having a higher odds, the control is executed such that the racing car having the lower odds is preferentially allowed to change to the inner running lane in the lane changing regions 902*a*. Further, when the two racing cars are running side by side, the control is executed such that one having the lower odds moves faster than the one having the higher odds.

However, the control conditions are not always the same, but rather vary depending upon the positions of the respective racing cars 7. For example, when the racing car 7 having the higher odds enters the lane changing regions 902*a* at an earlier timing than the one having the lower odds, it may be preferentially allowed to change to the inner running lane. Moreover, when the racing car is moving at a speed faster than a specified level, it may move along the currently running lane without changing the lane even if it enters the lane changing regions 902*a* at an earlier timing.

As described above, the respective racing cars 7 are basically controlled in accordance with the winning probabilities set for each race. However, after the start of the race, the speeds and positions (state on the racing course) which vary every moment according to the running situation are also considered in controlling the racing cars 7. By this control, the result of the race is not the one already set, but differs according to the progress of the race. Thus, the progress of the race becomes exceedingly unpredictable, thereby making the competition game more interesting.

The race ends after all the racing cars 7 pass the goal position 604 (Step #7). The result of the race and the payback ratio are displayed in the display 301 and the display screens of the respective input units 5. Thereafter, the winning forecasts inputted by the players and the result of the race are compared to discriminated whether they made the right forecasts (Step #8). If all the winning forecasts are missed (NO in Step #8), this routine returns to Step #1 and the game machine is brought into the stand-by state.

If at least one of the winning forecasts comes true (YES in Step #8), it is discriminated whether the race was a main race (Step #9). If the race was not a main race (NO in Step #9), the number of coins to be paid back is calculated by multiplying the number of coins to be betted by a given payback ratio; the number of coins corresponding to this calculated number are paid back to the player (Step #10); and this routine returns to Step #1.

If the race was a main race (YES in Step #9). the player is allowed to play a bonus game. This bonus game is performed to determine how much bonus the player gets. For example, a bonus ratio is set by playing a die. The player operates to play a die in accordance with what is displayed in the display screen 501 of the input unit 5 and a spot of the die becomes a bonus ratio. Thereafter, the number of coins to be paid back is calculated by multiplying the number of coins to be betted by the specified payback ratio times the bonus ratio and the number of coins corresponding to this calculated number are paid back to the player (Step #11). In other words, the player gets the coins which are normal payback coins times the bonus ratio. This routine returns to Step #1 when all the players are paid back and the game machine is brought into the stand-by state.

Although the (+) and (–) supplying lines 10, 11 are provided on the running track 9 to receive the power from the truck 17 in the foregoing embodiment, the (–) supplying lines 11 may be formed with the member other than the running track 9. For example, it may be appropriate to provide on the underside of the track 601 a separate supplying member formed with conduction lines 11 and to provide the contact members 27, 28 on the upper plate member 191 of the support member 19, so that the power can be obtained from the truck 17 and the support member 19. The polarities of the supplying lines 10, 11 may be reversed.

The foregoing embodiment is described with respect to a case where the running track 9 has 2 or 3 running lanes and a plurality of lane changing regions 902*a*. lane joining regions 902*b* and lane branching regions 902*c*. However, the invention is not limited to this case, but is applicable to any running track 9 provided that it consists of at least one running lane 901 having a plurality of running lanes and lane branching regions 902*b* in one region thereof. Further, although the foregoing embodiment is described with respect to a game machine where the dummy racing cars 7 are caused to move while being magnetically attracted to the driving machines 8, the invention is also applicable to a case where the racing cars 7 themselves move. In other words, the driving mechanism including the driving machines 8 and running track 9 below the racing course 6 may be deleted from the construction. In this case, the track 601 may have the substantially same construction as the running track 9 and each racing car 7 may be provided with the substantially same guide mechanism, driving mechanism and power supplying mechanism as the truck 17.

Although the foregoing embodiment is described with respect to the racing game machine, the invention is not limited to this, but is applicable to any desired competition game such as a horse race, a bicycle race and a dog race.

As described above, according to the invention, in a game machine in which at least two vehicles having a drive motor are caused to move along a running lane formed on a looped running track while power is supplied to the vehicles by way of the running track, the power supplied to each vehicle is controlled by way of a supplying line corresponding to this vehicle which is laid on a running lane of a running track. Thus, a plurality of vehicles moving along the same running lane can be securely controlled without causing an entanglement of information with a simple construction.

Further, the supplying lines include a common supplying line which acts as one electrode and is laid in a guide groove for guiding the running of each vehicle, and each vehicle is provided with a guide pin which is fitted in the guide groove and brought into pressing contact with the common supplying line. Thus, the supplying lines are arranged in a compact manner and yet a short circuit is highly unlikely to occur, and the power can be supplied stably and securely.

A contact part of contact member which is brought into pressing contact with the corresponding one of the supplying lines which act as the other electrode is formed into a steplike shape so as to have a plurality of contact portions. Accordingly, the contact member is in contact with the supplying line at one point or line and the next contact portion is brought into pressing contact with the supplying line each time the previous one is abraded due to the friction. Thus, the contact member is securely in pressing contact with the corresponding supplying line even when the contact part deforms as a result of abrasion, thereby preventing an imperfect contact.

The running track has, at least one region thereof, a multiple lane region where there are provided a plurality of running lanes and a lane branching region, at an upstream end of the multiple lane region, where at least one running lane is branched from a main running lane. At least one lane changing region is also provided in the multiple lane region so as to enable the vehicle to change its running lane. This enables the game machine to provide complicated running patterns with a simple construction, thereby making players feel, a higher presence.

Particularly, in the lane branching region or lane changing region, there are formed a guide groove corresponding to each running lane and a branch guide groove which is branched from this guide groove, and a switch member is provided at a position where the guide groove is branched and between front and rear surfaces of the running track. The switch member is movable between a first position where the guide pin of the vehicle is guided to the guide groove and a second position where it is guided to the branch guide groove. Thus, the running lane of the vehicle can be smoothly changed.

Further, each vehicle transmits an identification signal, which is received at specified position detecting points provided at the running track to detect the position of the vehicle on the run. Thus, the positions of a plurality of vehicles moving along the same lane can be securely detected. Particularly, since the identification signal is transmitted in the form of light, the positions can be securely detected even when the vehicles move at high speeds.

Furthermore, the running lane of each vehicle is controllably changed in the lane branching region or lane changing region based on speed information and position information of the vehicle. This enables a more complicated progress of a game, thereby making players feel higher presence of a competition game.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A game machine comprising:

a plurality of vehicles each having a drive motor;

a running track having an upper surface, a plurality of running lanes on said running track, each of said running lanes including a guide groove opening up onto said upper surface;

a common conductor extending along each of said guide grooves;

guide means on each of said vehicles, each of said guide means being moveable in a respective guide groove to guide each vehicle in its respective guide groove, said guide means contacting said common conductor as the guide means moves in the respective guide groove;

said guide means comprising an electrically conductive pin extending substantially vertically from said vehicle, said electrically conductive pin being electrically connected to the drive motor on the respective vehicle, said electrically conductive pin having a lower end slidably contacting said common conductor;

said vehicle comprising a first frame and a second frame, pivot means pivotably connecting said first frame to said second frame, said pivot means comprising a pivot pin which is slidably disposed in said guide groove, said pivot pin being spaced from said electrically conductive pin, said pivot pin and said electrically conductive pin each guiding the vehicle in its respective guide groove;

a plurality of separate conductor lines disposed on said upper surface juxtaposed to each guide groove and extending generally parallel to each respective guide groove;

contact means on each of said vehicles connected to the drive motor on the respective vehicle, each of said contact means overlying a respective conductor line on said upper surface of said running track, each of said contact means slidably contacting a different one of said plurality of conductor lines such that each drive motor is thereby electrically connected to a separate conductor line; and power supply means supplying electric power to said conductor lines such that each drive motor is thereby connected to said power supply means via a separate conductor line.

2. A game machine according to claim 1 wherein said electrically conductive pin is mounted on said second frame such that said electrically conductive pin and said pivot pin guide said second frame in said guide groove, said first frame being pivotal about said pivot pin relative to said second frame.

3. A game machine according to claim 1 wherein said contact means are mounted on said second frame.

4. A game machine according to claim 1 wherein said drive motor is mounted on said first frame.

5. A game machine according to claim 1 further comprising first wheels mounted on said first frame and second wheels mounted on said second frame, each of said first and second wheels being in rolling contact with said running track.

6. A game machine comprising:

a plurality of vehicles each having a drive motor;

a running track having an upper surface, a plurality of running lanes on said running track, each of said running lanes including a guide groove opening up onto said upper surface;

a race track overlying and substantially parallel to said running track, said race track being spaced from said running track to thereby form an operating space between said race track and said running track, each of said vehicles comprising a vehicle racing unit and a driving means, said vehicle racing unit having wheels running on said race track, said driving means being disposed in said operating space between said race track and said running track;

said driving means comprising upper wheels rotatably contacting the underside of said race track, said driving means comprising lower wheels rotatably contacting said running track, said driving means further comprising biasing means effecting biasing contact between said upper wheels and said underside of said race track and biasing contact between said lower wheels and said running track;

a common conductor extending along each of said guide grooves;

guide means on each of said vehicles, each of said guide means being moveable in a respective guide groove to guide each racing unit in its respective guide groove, said guide means contacting said common conductor as the guide means moves in the respective guide groove;

a plurality of separate conductor lines disposed on said upper surface juxtaposed to each guide groove and extending generally parallel to each respective guide groove;

contact means on each of said vehicles connected to the drive motor on the respective vehicle, each of said contact means overlying a respective conductor line on said upper surface of said running track, each of said contact means slidably contacting a different one of said plurality of conductor lines such that each drive motor is thereby electrically connected to a separate conductor line;

said guide means and said contact means being disposed on said driving means, and magnetic means on said vehicle and on said driving means providing a magnetic coupling between said vehicle on said race track and said driving means in said operating space; and power supply means supplying electric power to said conductor lines such that each drive motor is thereby connected to said power supply means via a separate conductor line.

7. A game machine according to claim 3 wherein said driving means comprises one driving means section on which said upper wheels are rotatably mounted and another driving means section on which said lower wheels are rotatably mounted, said driving means further comprising connecting means connecting said one driving means section to said other driving means section, said connecting means providing for relative movement between said one driving means section and said other driving means section, said biasing means providing a biasing relationship between said one and said other biasing means section.

8. A game machine comprising:

a plurality of vehicles each having a drive motor and a contactor;

a running track provided with a plurality of running lanes along which the vehicles move;

a power generator means for generating power to be supplied to each vehicle to control the speed of the vehicle;

a plurality of supply lines provided on each of the running lanes of the running track to supply the power generated by the power generator means to the corresponding vehicles running in each running track, said contactor on each of said vehicles being in sliding contact with a separate supply line such that each drive motor is supplied with the power generated by the power generator means via a separate supply line;

said contactor on each of said vehicles comprising a resilient strip member having contactor portions disposed at different levels relative to the supply line being contacted, one of said contactor portions at one level being in sliding contact with a respective supply line while another contactor at another level is spaced from the supply line slidably contacted by said one contactor portion, said other contactor portion at said another level coming into sliding contact with said respective supply line after said one contactor portion has became abraded away.

9. A game machine according to claim 8 wherein said contactor portions are disposed in steps with each step being progressively further spaced from the respective supply line.

10. A game machine according to claim 8 further comprising rotatable means for rotatably mounting said strip member on said vehicle.

11. A game machine according to claim 8 further comprising biasing means biasing said strip member into biasing contact with the respective supply line, said biasing means being operable to effect biasing contact between each of said contactor portions and the respective supply line.

* * * * *